US006726042B2

(12) United States Patent
Schweigert et al.

(10) Patent No.: US 6,726,042 B2
(45) Date of Patent: Apr. 27, 2004

(54) TAMPER EVIDENT CLOSURE

(75) Inventors: Lothar Schweigert, Incline Village, NV (US); Ui Hwan O, Los Angeles, CA (US)

(73) Assignee: Delta Plastics, Inc., Hot Springs, AR (US)

( * ) Notice: Subject to any disclaimer, the term of this patent is extended or adjusted under 35 U.S.C. 154(b) by 0 days.

(21) Appl. No.: 10/043,447

(22) Filed: Jan. 10, 2002

(65) Prior Publication Data

US 2003/0127418 A1 Jul. 10, 2003

(51) Int. Cl.[7] ..... B65D 41/34

(52) U.S. Cl. ..... 215/252; 215/258; 215/317; 215/321; 215/901

(58) Field of Search ..... 215/252, 258, 215/317, 319, 321, 901, 256, 253, 382, 353

(56) References Cited

U.S. PATENT DOCUMENTS

| | | | | |
|---|---|---|---|---|
| 3,455,478 A | | 7/1969 | Fields et al. | 215/7 |
| 4,352,436 A | | 10/1982 | Chartier et al. | 215/252 |
| 4,505,401 A | | 3/1985 | Berglund | 215/252 |
| 4,529,096 A | | 7/1985 | Chartier et al. | 215/252 |
| 4,625,875 A | | 12/1986 | Carr et al. | 215/232 |
| 4,907,708 A | | 3/1990 | Csaszar | 215/252 |
| 5,295,600 A | | 3/1994 | Kowal | 215/252 |
| 5,487,481 A | | 1/1996 | Sander et al. | 215/252 |
| 5,680,945 A | | 10/1997 | Sander et al. | 215/252 |
| 5,893,474 A | * | 4/1999 | Herrmann et al. | 215/252 |
| 5,992,657 A | | 11/1999 | Friedman | 215/209 |
| 6,068,151 A | | 5/2000 | Recendez | 215/252 |
| 6,089,390 A | * | 7/2000 | Druitt et al. | 215/252 |
| 6,099,785 A | | 8/2000 | Schweigert et al. | 264/328.1 |
| 6,264,052 B1 | * | 7/2001 | Schmitz | 215/252 |
| 2001/0002661 A1 | * | 6/2001 | Reidenbach | 215/252 |

FOREIGN PATENT DOCUMENTS

| | | | | |
|---|---|---|---|---|
| DE | 3233806 A | * | 3/1984 | B65D/41/34 |
| WO | WO 94/O2371 | | 2/1994 | B65D/41/34 |
| WO | WO 94/14674 | | 7/1994 | B65D/41/34 |

* cited by examiner

*Primary Examiner*—Stephen K. Cronin
*Assistant Examiner*—James Smalley
(74) *Attorney, Agent, or Firm*—Wood, Herron & Evans, LLP

(57) ABSTRACT

A closure for a container has a cap portion with screw threads to engage screw threads on the container and a tamper evident band connected to the cap by frangible bridge elements. The tamper evident band includes segments that engage a retaining flange on the container to separate the band when the closure is first removed from the container. Expansion segments on the band permit the closure to be initially installed on the container without breaking the frangible elements.

11 Claims, 3 Drawing Sheets

TAMPER EVIDENT CLOSURE

FIELD OF THE INVENTION

This invention relates to enclosures for containers, and more particularly to closures which indicate an initial opening of the container.

BACKGROUND OF THE INVENTION

Manufacturers of consumer goods and purchasers of those goods are concerned with ensuring that products available in the marketplace are not tampered with prior to being opened and used by the ultimate consumer of the goods. For this reason, it is conventional to provide consumer goods in containers having tamper evident closures. Such tamper evident closures are well known in the art, including closures for containers having external screw threads near the opening of the container, such as bottles and jars. In general, such closures have a cap and a tamper evident band which is frangibly connected to the cap. When the closure is initially removed from a container, the frangible connection breaks to separate the tamper evident band from the cap to indicate that the container has been opened. The cap typically includes a threaded portion having interior screw threads, or thread segments, which mate with the screw threads of the container to permit the closure to be screwed onto the container and thereby seal the container. The tamper evident band generally includes one or more ribs which protrude inwardly of the band to engage a retaining flange on the container which is generally positioned beneath the screw threads of the container.

One drawback of prior tamper evident closures is that it is often difficult to install the closure on a container for initial closure of the container without damaging the frangible connections between the cap portion and the tamper evident band. This problem is exacerbated in light of the need to initially install the closures on the containers in a relatively high-speed production line, where the high-speed installation of caps increases the possibility of breaking the frangible connections. One solution to this problem has been to provide a recently molded tamper evident band which has not set and is pliable enough to be installed to a container by permitting stretching of the tamper evident band over the retaining flange of the container without breaking the frangible connections. However, the timing for installing such a closure is critical and often problematic in a mass-production process.

Thus, a need exists for a tamper evident closure which may be easily and quickly installed onto a container without rupturing the frangible connections between the cap portion and the tamper evident band of the closure, while providing a reliable indication of an initial opening of the container.

SUMMARY OF THE INVENTION

The present invention provides a tamper evident closure which may be initially installed onto a container without damaging the tamper evident feature, yet provides a reliable indication of a first opening of the container. The closure includes at least one expansion segment on a tamper evident band of the closure which permits the band to be initially installed over a retaining flange on a container without breaking frangible connections between the band and a cap of the closure. The expansion segment permits closures to be quickly installed on containers and are therefore suitable for use in typical production lines.

In an exemplary embodiment, a closure of the present invention includes a cap portion and a tamper evident band portion connected by a series of frangible bridges. The cap portion of the closure includes interior threads which permit the closure to be screwed onto a container having corresponding screw threads on a neck of the container. The tamper evident band is made up of several segments formed together into a unitary piece. The band includes container engaging segments which mate with a retaining flange on a container, and expansion segments which stretch during an initial installation of the closure on the container to permit the closure to be installed without breaking the frangible bridges.

The container engaging segments have raised ribs which are configured to engage the retaining flange of the container. In an exemplary embodiment, the ribs are generally triangular in shape, with a flat surface to engage the retaining flange and a sloped surface which facilitates installation of the band over the retaining flange. The raised ribs extend continuously along the lengths of the container engaging segments. In this embodiment, each container engaging segment has two raised ribs. In another exemplary embodiment, the container engaging segments have a single raised rib.

The expansion segments are positioned between the container engaging segments and do not have raised ribs for engaging the retaining flange of the container. In an exemplary embodiment, the container engaging segments define a peripheral boundary and the expansion segments extend arcuately from the peripheral boundary to create discontinuities in the tamper evident band. Advantageously the container engaging segments and the expansion segments are formed integrally and no subsequent operations are required to create the expansion segment, such as forming slits in the band.

In another aspect of the invention, a tamper evident container system includes a container and a tamper evident closure. The container has an opening and screw threads near the opening for receiving the closure. The closure comprises a cap, with screw threads which mate with the screw threads on the container, and a tamper evident band made up of container engaging segments and expansion segments. The expansion segments permit the closure to be initially installed to the container without damaging the tamper evident features of the closure.

In yet another aspect of the invention, a method for installing a tamper evident closure on a container includes the steps of positioning the closure on an opening of the container and turning the closure to screw the closure onto the container and expand expansion segments on a tamper evident band of the closure, whereby the closure is secured on the container without breaking frangible connections on the band.

These and other features, advantages and objectives of the invention will become more readily apparent to those of ordinary skill in the art upon review of the following detailed description of the preferred embodiments, taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION OF THE INVENTION

Figure 1:
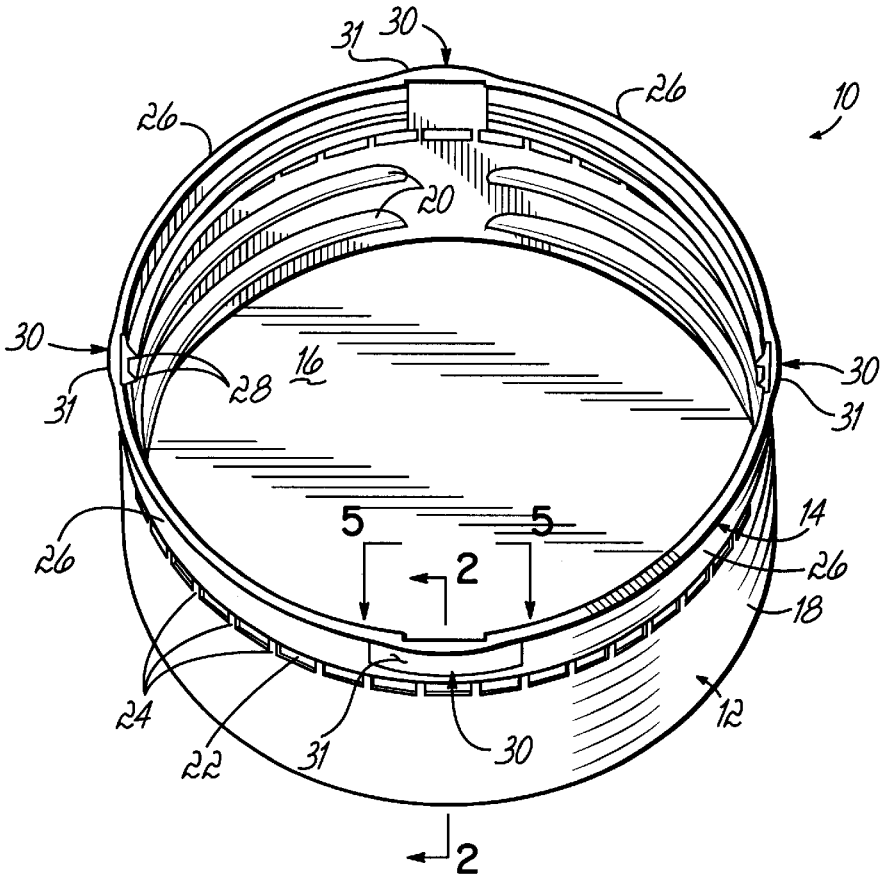
FIG. 1 is a perspective view of an exemplary embodiment of a tamper evident closure, according to the principles of the present invention.
Figure 2:
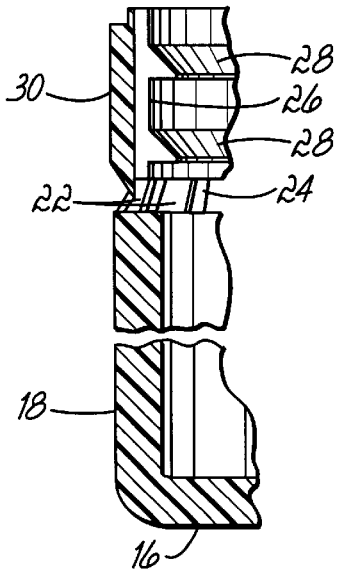
FIG. 2 is a partial cross-sectional view of the tamper evident closure of FIG. 1 taken along line 2—2.

Referring to FIGS. 1 and 2, an exemplary embodiment of a tamper evident closure 10 including a cap 12 and a tamper evident band 14 according to the principles of the present invention is shown. The closure 10 comprises an end wall 16 and at least one skirt 18 adjacent to the end wall 16 to define the cap portion 12 of the closure 10. In the exemplary embodiment shown in FIG. 1, the closure 10 is generally circular in shape and has a single skirt 18. Screw threads or screw thread segments 20 are disposed on an inwardly facing portion of the skirt 18 and are configured to engage corresponding threads on the necked opening of a container. The skirt 18 has a terminal edge 22 opposite the end wall 16, as shown most clearly in FIG. 2.

The closure 10 also includes a tamper evident band 14 which is connected to the terminal edge 22 of the skirt 18 by a series of frangible bridge elements 24 disposed around the terminal edge 22 of the skirt 18. The tamper evident band 14 is made up of several segments joined together around the terminal edge 22 of the skirt 18. The band 14 includes several container engaging segments 26 which are configured to engage a retaining flange on the container. To this end, raised ribs 28 are disposed on an inward facing surface of the container engaging segments 26 and are configured to engage the retaining flange of the container. Advantageously, the raised ribs 28 are continuous along the entire length of the container engaging segments 26. The tamper evident band 14 also includes expansion segments 30 connected to and disposed between the container engaging segments 26. The expansion segments 30 may be integrally formed with the container engaging segments 26, but the expansion segments 30 do not have raised ribs for engaging the retaining flange of the container. As shown in FIGS. 1 and 5, each expansion segment 30 has a tapered and raised exterior face 31 relative to the perimeter of the engaging segments 26 of the band 14.

In the exemplary embodiment shown in FIG. 1, the closure 10 has four container engaging segments 26 spaced around the terminal edge 22 of the skirt 18, and four expansion segments 30 evenly spaced around the terminal edge 22 of the skirt 18 and positioned between the container engaging segments 26. One of ordinary skill in the art will understand that a different number and arrangement of container engaging segments 26 and expansion segments 30 may be used without departing from the scope of the invention, but the closure 10 should have at least one container engaging segment 26 and at least one expansion segment 30.

As best shown in FIGS. 1 and 2, the expansion segments 30 of the exemplary embodiment extend arcuately out from a peripheral boundary defined by the group of container engaging segments 26, creating a discontinuity between the container engaging segments 26. Advantageously, the expansion segments 30, the container engaging segments 26, and the frangible bridges 24 are integrally formed with the cap portion 12 of the closure 10. Thus, the entire closure 10 may be formed in a single molding operation without the need for subsequent operations, such as slitting. A presently preferred method and system of making the closure is disclosed in U.S. Pat. No. 6,099,785, which is hereby incorporated by reference entirely.

Figure 3:
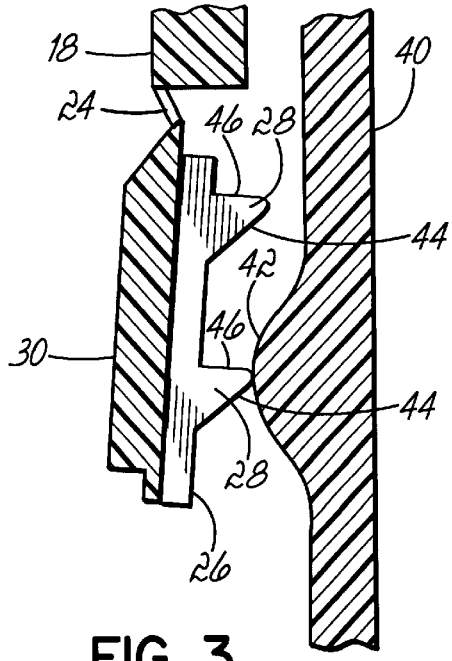
FIG. 3 is a partial cross-sectional view depicting the tamper evident band of the present invention being installed over a retaining flange of a container.
Figure 4:
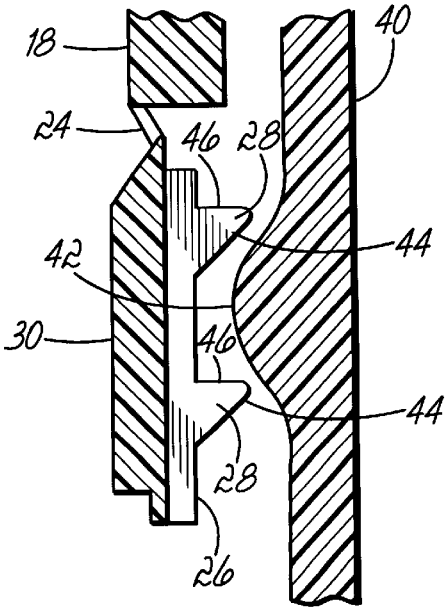
FIG. 4 shows a partial cross-sectional view of the tamper evident band of FIG. 3 with the raised ribs in position over the retaining flange of a container.

In use, the expansion segments 30 permit the closure 10 to be applied to a container for an initial closing of the container without breaking the frangible bridge elements 24 connecting the tamper evident band 14 to the cap portion 12 of the closure 10. Referring to FIGS. 3 through 5, the initial installation of the closure 10 of the present invention will now be described. As the closure 10 is placed on the opening of the container 40 to engage the screw threads 20 of the closure 10 with the screw threads (not shown) of the container 40, the raised ribs 28 on the container engaging segments 26 of the closure 10 are brought into contact with a retaining flange 42 on the container 40. In the exemplary embodiment shown in FIGS. 3 and 4, the closure 10 includes two raised ribs 28 disposed on the container engaging segment 26 of the closure 10, whereby the retaining flange 42 is positioned between the raised ribs 28 when the closure 10 is fully secured on the container 40. Alternatively, the closure 10 may have only one rib 28, or it may have more than two ribs 28.

As closure 10 is then turned relative to the container 40 for installation onto the container 40, at least one of the raised ribs 28 is urged past the retaining flange 42 on the container 40. Advantageously, the raised ribs 28 are shaped to permit the ribs 28 to slide over the retaining flange 42 of the container 40 while the closure 10 is being screwed onto the container 40, but to resist movement of the closure 10 away from the container 40 and back over the retaining flange 42 when the closure 10 is turned to remove the closure 10 from the container 40. In the exemplary embodiment shown in FIGS. 3 and 4, the raised ribs 28 have a generally triangular shape in cross-section, with a sloped surface 44 facing in a direction generally away from the end wall 16 and a generally planar engaging surface 46 facing in a direction generally parallel to and toward the end wall 16 of the closure 10. The sloped edge 44 permits the ribs 28 to pass over the retaining flange 42 when the closure 10 is screwed onto the container 40 and the generally flat edge 46 resists the motion of the tamper evident band 14 away from the container when the closure 10 is screwed off of the container 40.

Figure 5A:
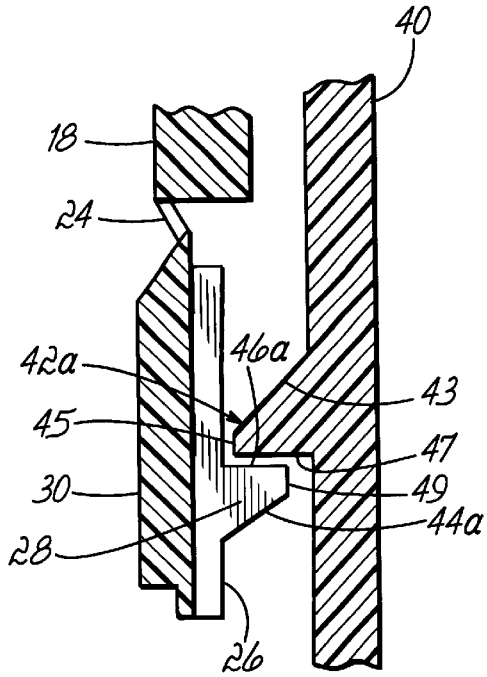
FIG. 5A is a view similar to FIG. 4 of an alternative embodiment of this invention.
Figure 5:
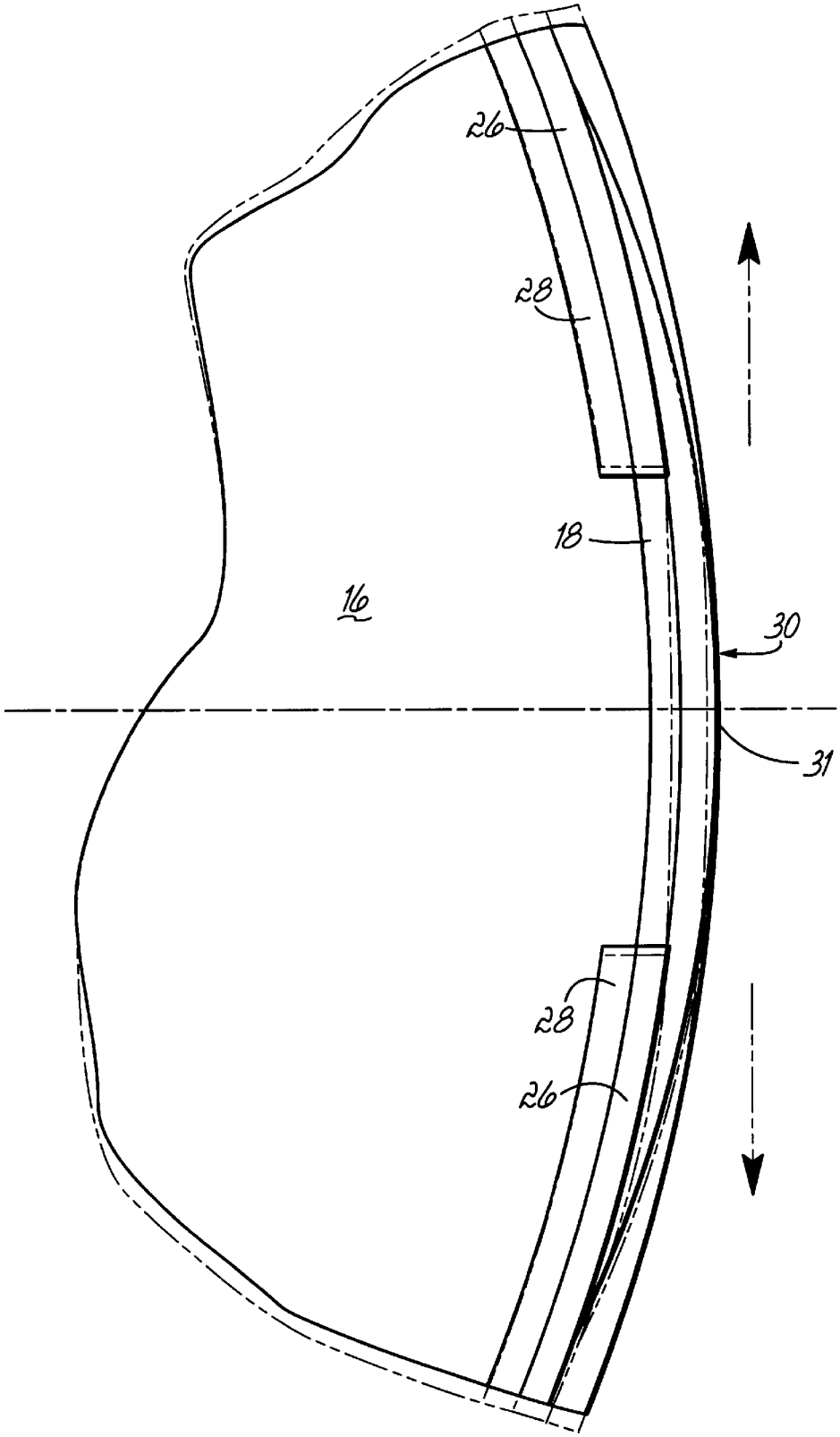
FIG. 5 is a partial plan view of the tamper evident closure of FIG. 1 taken along line 5—5 and depicting an expansion of the tamper evident band in phantom.

Alternatively, as shown in FIG. 5A, the container 40 may have a retaining flange 42*a* with a truncated triangular configuration, including a downward sloping face 43, an outer face 45 and a lower face 47. The raised rib(s) 28*a* has a planar engaging surface 46*a* on the tamper evident band 14 confronting the face 47 once the closure is initially installed on the container 40. The rib 28*a* also has an outer face 49 and an upwardly sloping face 44*a*.

As shown in FIGS. 3, 5 and 5A, when the raised rib 28, 28*a* is forced over the retaining flange 42, 42*a* of the container 40, the expansion segment 30 stretches to expand the tamper evident band 14 circumferentially and to permit the raised rib 28, 28*a* to pass over the retaining flange 42, 42*a* without breaking the frangible bridges 24 connecting the tamper evident band 14 to the cap portion 12 of the closure 10. This stretching of the expansion segment 30 works in conjunction with the shape of the raised ribs 28,

28*a* to permit the closure 10 to be initially installed on a container 40 without breaking the frangible bridges 24 connecting the tamper evident band 14 to the cap portion 12. After the initial installation, the expansion segment 30 contracts toward its initial length to secure the tamper evident band 14 proximate the retaining flange 42, 42*a*. When the closure 10 is screwed off of the container 40 after the initial installation, the raised ribs 28, 28*a* engage the retaining flange 42, 42*a* to prevent the band 14 from moving with the cap 12. The frangible bridges 24 break and the band 14 is separated from the cap 12.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of applicant's general inventive concept.

What is claimed is:

1. A tamper evident closure comprising:

an end wall;

a skirt adjacent said end wall, said skirt having a terminal edge opposite said end wall, said skirt having a configuration that does not facilitate radial expansion of said skirt;

at least one container engaging segment proximate said skirt and spaced around said terminal edge;

at least one expansion segment proximate said skirt and positioned adjacent said container engaging segment; and a plurality of frangible bridge elements connecting said container engaging segment and said expansion segment to said terminal edge;

wherein said container engaging segment defines a peripheral boundary and said expansion segment extends arcuately outward from the peripheral boundary of said container engaging segment.

2. A tamper evident closure comprising:

an end wall;

a skirt adjacent said end wall, said skin having a terminal edge opposite said end wall, said skirt having a configuration that does not facilitate radial expansion of said skirt;

at least one container engaging segment proximate said skirt and spaced around said terminal edge, said container engaging segment defining a peripheral boundary;

at least one expansion segment proximate said skirt and positioned adjacent said container engaging segment, said expansion segment extending outwardly from said peripheral boundary;

a plurality of frangible bridge elements connecting said container engaging segment and said expansion segment to said terminal edge; and two raised ribs disposed on each of said container engaging segments and shaped to engage an outwardly extending portion of a container.

3. A tamper evident container system comprising:

a container having an opening and screw threads proximate said opening; and a tamper evident closure comprising:

an end wall;

a skirt adjacent said end wail to define a cap, said skirt having a terminal edge opposite said end wall, said skirt having a configuration that does not facilitate radial expansion of said skirt;

at least one container engaging segment proximate said skirt and spaced around said terminal edge, said container engaging segment defining a peripheral boundary;

at least one expansion segment proximate said skin and positioned adjacent said container engaging segment, said expansion segment extending outwardly from said peripheral boundary;

a plurality of frangible bridge elements connecting said container engaging segment and said expansion segment to said terminal edge;

at least one raised rib disposed on each of said container engaging segments and shaped to engage an outwardly extending portion of a container;

a sloped surface on each said rib, said sloped surface facing away from said end wall to assist in initial installation of the closure onto a container; and an engaging surface on each said rib, said engaging surface parallel to said end wall to assist in fracturing said frangible bridge elements upon initial removal of the closure from the container.

4. The tamper evident container system of claim 3 wherein said expansion segment is integrally formed with said container engaging segment.

5. A tamper evident container system comprising;

a container having an opening and screw threads proximate said opening; and a tamper evident closure comprising:

an end wall;

a skirt adjacent said end wall, said skirt having a terminal edge opposite said end wall, said skirt having a configuration that does not facilitate radial expansion of said skirt;

at least one container engaging segment proximate said skirt and spaced around said terminal edge;

at least one expansion segment proximate said skirt and positioned adjacent said container engaging segment; and a plurality of frangible bridge elements connecting said container engaging segment and said expansion segment to said terminal edge;

wherein said container engaging segments define a peripheral boundary and said expansion segment extends arcuately outward from the peripheral boundary of said container engaging segment.

6. A tamper evident closure for a container, comprising:

an end wall;

a skirt adjacent said end wall to define a cap, said skirt having a terminal edge opposite said end wall, said skirt having a configuration that does not facilitate radial expansion of said skirt;

a plurality of container engaging segments proximate said skirt and spaced around said terminal edge to define a peripheral boundary proximate said skirt;

a plurality of expansion segments proximate said skirt and integrally formed with said container engaging segments, said expansion segments extending arcuately from the peripheral boundary defined by said container engaging segments;

a plurality of frangible bridge elements connecting said container engaging segments and said expansion segments to said terminal edge; and a pair of raised ribs disposed on each of said container engaging segments, the raised ribs continuous along the lengths of the container engaging segments and shaped to engage an outwardly extending portion of a container.

7. The closure of claim 6 having four container engaging segments and four expansion segments.

8. The closure of claim 6 wherein said raised ribs are generally triangular in cross section and have an engaging surface for engaging an outwardly extending portion of a container and a sloped surface which permits the ribs to be urged over the outwardly extending portion of the container.

9. A method of installing a tamper evident closure on a container having an opening, screw threads proximate the opening, and a retaining flange, the method comprising:

positioning the closure adjacent the opening of the container to engage threads of the closure with the threads of the containers the tamper evident closure having a skirt having a radial periphery and a tamper evident band comprising container engaging segments and expansion segments, wherein the container engaging segments define a peripheral boundary and the expansion segments extend arcuately outward from the peripheral boundary of the container engaging segments;

turning the closure relative to the container to screw the closure onto the container;

maintaining the radial periphery of the skirt;

expanding the arcuately outward extending expansion segments from an initial length to enable the tamper evident band to pass over the retaining flange without separating the band from the closure; and contracting the arcuately outward extending expansion segments toward their initial length after the tamper evident band has passed the retaining flange to secure the closure to the container.

10. A tamper evident closure comprising:

an end wall;

a skirt adjacent said end wall, said skirt having a terminal edge opposite said end wall, said skirt having a configuration that does not facilitate radial expansion of said skirt;

at least one container engaging segment proximate said skirt and spaced around said terminal edge, said container engaging segment defining a peripheral boundary;

at least one expansion segment proximate said skin and positioned adjacent said container engaging segment, said expansion segment extending outwardly of said peripheral boundary;

a plurality of frangible bridge elements connecting said container engaging segment and said expansion segment to said terminal edge; and a plurality of raised ribs disposed on each of said container engaging segments and shaped to engage an outwardly extending portion of a container.

11. A tamper evident closure comprising:

an end wall;

a skin adjacent said end wall, said skirt having a terminal edge opposite said end wall, said skirt having a configuration that does not facilitate radial expansion of said skirt;

at least one container engaging segment proximate said skirt and spaced around said terminal edge to define a peripheral boundary;

at least one expansion segment proximate said skirt and positioned adjacent said container engaging segment, said expansion segment extending outwardly from the peripheral boundary defined by said container engaging segment; and a plurality of frangible bridge elements connecting said container engaging segment and said expansion segment to said terminal edge.

* * * * *

UNITED STATES PATENT AND TRADEMARK OFFICE

CERTIFICATE OF CORRECTION

PATENT NO. : 6,726,042 B2
DATED : April 27, 2004
INVENTOR(S) : Schweigert et al.

It is certified that error appears in the above-identified patent and that said Letters Patent is hereby corrected as shown below:

Column 5,
Line 46, “skin” should read -- skirt --.

Column 6,
Line 3, “wail” should read -- wall --.
Line 10, “skin” should read -- skirt --.

Column 7,
Line 18, “containers” should read -- container, --.

Column 8,
Lines 10 and 23, “skin” should read -- skirt --.

Signed and Sealed this

Thirteenth Day of July, 2004

JON W. DUDAS
*Acting Director of the United States Patent and Trademark Office*